United States Patent [19]

Kravetz et al.

[11] 4,025,453

[45] May 24, 1977

[54] ACTIVATED BLEACHING PROCESS AND COMPOSITIONS THEREFOR

[75] Inventors: Louis Kravetz; Eugene F. Lutz, both of Houston, Tex.

[73] Assignee: Shell Oil Company, Houston, Tex.

[22] Filed: Feb. 9, 1976

[21] Appl. No.: 656,464

[52] U.S. Cl. ..... 252/102; 252/95; 252/99; 252/103; 252/186; 8/111; 427/221; 252/DIG. 12

[51] Int. Cl.[2] ..... C11D 7/54

[58] Field of Search ..... 252/186, 99, 103, 94, 252/102, 95; 8/111

[56] References Cited

UNITED STATES PATENTS 3,756,774 9/1973 Kirner ..... 252/99

*Primary Examiner*—Mayer Weinblatt

[57] ABSTRACT

A process for the activation of peroxide-based bleaches comprises conjointly incorporating into an aqueous medium a peroxide-based bleach, a buffering agent to maintain the aqueous medium at a pH above 7.5, and cyanamide, which has been found to be a highly effective peroxide activator when employed under alkaline conditions. Stable concentrated liquid and solid cyanamide-activated bleaching compositions are also disclosed.

27 Claims, No Drawings

ACTIVATED BLEACHING PROCESS AND COMPOSITIONS THEREFOR

BACKGROUND OF THE INVENTION

1. Field of the Invention

The present invention relates to an improved process for activating peroxide-based bleaches. In addition, it relates to concentrated bleaching compositions which alone or in combination with other ingredients, can be added to an aqueous medium to effect the bleaching of fibrous materials and other bleachable substances over a wide range of temperatures.

2. Description of the Prior Art

Peroxide-based bleaches, such as hydrogen peroxide and perborates, are well known in the art and have been used for a number of years for bleaching textiles, and more recently, in home laundering applications for the bleaching of fabrics which cannot be safely bleached with chlorine-based bleaches because of problems with fiber or color damage. However, for home laundering use peroxide-based bleaching agents generally have the disadvantage, as compared to chlorine-base bleaches, that their bleaching effectiveness falls off rapidly as the temperature decreases. For example, peroxide-based bleaches are relatively ineffective at 60°–160° F, which are typical temperatures for home laundering in the United States.

Considerable effort has been devoted over the years to improve the effectiveness of peroxide-based bleaches at lower temperatures. One approach involves catalytic activation with the use of transition metals which decompose hydrogen peroxide to more reactive moieties which accelerate bleaching at lower temperatures. These activators generally must be used in the presence of compounds having suitable sequestering properties to prevent useless decomposition of the hydrogen peroxide. U.S. Pat. No. 2,975,139 to Kauffman et al and U.S. Pat. No. 3,156,654 to Konecny et al are representative of this approach. However, despite its technical feasibitily, catalytic activation has not found lasting commercial application because of the difficulty in controlling the activation phenomenon under practical conditions, and interference by other chemical substances commonly found in bleach/detergent compositions.

A different approach to activation involves the use of "organic activators" which react with hydrogen peroxide to form peracids, which are relatively strong bleching agents. A great number of these so-called organic activators are described in the prior art and generally comprise compounds having one or more acyl groups. U.S. Pat. No. 2,898,181 to Dithmar et al, for example, discloses certain carboxylic acid amides as activators for perborate bleaching agents. U.S. Pat. No. 3,163,606 to Viveen et al. discloses a variety of diacylated nitrogen containing compounds as activators for active oxygen releasing bleaches. Among the compounds specifically disclosed in this patent are N,N-diacetylcyanamide and the N-diacyldicynodiamides. U.S. Pat. No. 3,583,924 to Demangeon et al disclosed a four component cleaning composition including a mineral persalt, an organic activator therefore, a water soluble cupric salt and a copper complexing agent. N,N-diacetylcyanamide ad the N-diacyldicyanodiamides are also among the actavators for the persalts specifically disclosed in this patent. A later issued Dithamr et al. patent, U.S. Pat. No. 2,927,840, discloses that certain organic nitriles are likewise activators for peroxidic compounds. The patent teaches that the best results are obtained with organic nitriles containing a plurality of nitrile groups which are not separated too far from each other.

A further patent, U.S. Pat. No. 3,756,774 to Kirner, discloses that organic nitriles will react with hydrogen peroxide under acidic conditions to form stable peroxy carboximides which can be employed in the bleaching of cellulosic textile materials in place of alkaline hydrogen peroxide solutions stabilized with sodium silicate. Among the various organic nitriles disclosed as being suitable for this purpose are cyanamide and dicyanodiamide.

Despite the extensive efforts devoted by those skilled in the art to finding suitable activators for peroxide-based bleaches, there is in the United States today little practical application of this technology.

There are a number of reasons for this. One is that organic activators generally must be used in equimolar proportions with the active oxygen releasing component of the bleach package. Since most organic activators are relatively expensive, this results in the activator contributing significantly to the cost of the bleach formulation, and in many cases makes the product prohibitively expensive relative to competitive hypochlorite bleaches. Also, many prior art organic activators are relatively toxic or have unpleasant odors which render them unsuitable for use in applications such as home laundering.

A further drawback of many known organic activators is that they are unstable and, hence, are not suitable for use in commercial bleach products which are subject to storage over extended periods of time in warehouses or on the supermarket shelf before consumer use.

The present invention provides a bleach activation process and related compositions based on an activator which when employed under alkaline conditions not only provides subtantially improved bleaching action at relatively low temperatures, but, in addition, is inexpensive and does not suffer from the drawbacks of most of the prior art organic activators, or at least to a substantially lesser degree.

SUMMARY OF THE INVENTION

It has now been found, and forms the basis of the present invention, that cyanamide ($H_2NCN$) when employed under alkaline conditions, is a uniquely effective activator for peroxide-based bleaches over a wide range of temperatures, including low temperatures, such as those encountered in home laundering in the United States. Thus, the present invention provides an improved peroxide-based bleach activation process which comprises conjointly incorporating into an aqueous medium effective amounts of (a) a peroxide-base bleach, (b) a peroxide-activating amount of cyanamide and (c) a buffering agent to maintain the aqueous medium under alkaline conditions. The present invention also provides stable concentrated liquid or solid (dry) peroxide-based bleaching compositions which may be used for bleaching as such, or as a component of a soap or detergent formulation. Alternatively, the peroxide-based bleach and cyanamide activator may be added separately in liquid or solid form to a aqueous medium, together with sufficient buffering agent to maintain the aqueous bleaching/washing medium under alkaline conditions.

In addition to discovering the unique effectiveness of cyanamide under alkaline conditions as a peroxide bleach activator over a relatively broad range of concentrations, it has been further found that when cyanamide and the bleach component are present in certain specific proportions, an unexpected improvement in formulation stability results even at relatively high temperatures. If still further stability is desired, various stabilizers can be incorporated into the compositions of the invention, such as stannates, pyrophosphates, ethylenediamine tetraacetic acid and its salts and higher homologs, citric acid, acetic acid, gluconic acid and sodium tripolyphosphate.

It has also been found that not only does cyanamide under alkaline conditions enhance the bleaching effectiveness of peroxide-based bleaches, but in addition cyanamide-activated peroxide-based bleaches appear to significantly improve the detergency of many conventional detergents, which makes the instant compositions particularly attractive for use in laundry applications.

DETAILED DESCRIPTION OF THE INVENTION

Fundamental to this invention is the discovery that cyanamide, a commercially available, relatively inexpensive material, when employed under alkaline conditions, is a surprisingly effective activator for peroxide-based bleaches. By peroxide-based bleaches as this term is used in this specification and claims, is meant hydrogen peroxide and any compound which releases hydrogen peroxide in aqueous solution. Such compounds include, for example, perborates, percarbonates, urea peroxides and ketone peroxides. Peroxy compounds of this type and their manner of preparation are well known in the art, and are described, for example, in Kirk-Othmer, Encyclopedia of Chemical Technology, 2nd ed. Vol. 14, pp. 757–760. Of the various peroxide-based bleaches which can be suitably employed in accordance with the invention, hydrogen peroxide, perborates and pecarbonates are preferred. Particularly preferred among the perborates are the sodium perborates, especially sodium perborate tetrahydrate ($NaBO_3.4H_2O$) because of its commercial availability. However, sodium perborate trihydrate ($NaBO_3.3H_2O$) and sodium perborate monohydrate ($NaBO_3.H_2O$) can also be suitably employed.

The mechanism by which cyanamide effects activation of peroxide-based bleaches is not precisely known. However, it has been found that in order to obtain an effective level of bleaching, it is critical that the aqueous medium in which the bleaching or washing is accomplished (e.g., a washing machine in the case of home laundering) be maintained under alkaline conditions, e.g., at a pH of at least 7.5., preferably from 7.5 to about 13. A particularly preferred pH range for the aqueous washing/bleaching medium is from about 8 to about 11.5 Buffering of the bleaching/washing medium to the desired pH can be accomplished by adding an alkali and/or an alkaline buffering agent to the bleaching/washing medium prior to, concurrently with, or after the addition of the cyanamide/peroxide-based bleach. A convenient means of accomplishing buffering in the case of laundering applications is by the use of detergents, which commonly contain alkaline buffering agents.

While it is necessary that the pH of the aqueous medium in which bleaching is effected be in the alkaline range in order to realize the benefits of the invention, in order to obtain a storage stable liquid bleach concentrate it is important that pH of the liquid bleach concentrate be kept at a relatively low pH, e.g., a pH below 5, while in storage until it is ready for use, at which time the pH can be adjusted to a pH of 7.5 or higher by the addition of an alkali or an alkaline buffering agent, as previously discussed. In this manner premature reaction and/or decomposition of cyanamide and the peroxide-based bleach can be avoided (i.e., cyanamide undergoes various addition reactions under alkaline conditions, sometimes accompanied by a further increase in pH. Hydrogen peroxide may decompose by either free radical or ionic reactions, which in general proceed more rapidly at higher pH values).

Thus, stable concentrated liquid bleach in accordance with the invention comprise a liquid peroxide-based bleach, a peroxide-activating amount of cyanamide and a buffering agent to maintain the pH of the bleach concentrate below about 5, preferably at a pH of from 2 to 5, and most preferably at a pH of about 4. The preferred peroxide-based bleach for use in liquid compositions is an aqueous hydrogen peroxide solution, optionally containing an organic liquid stabilizing agent.

Stable concentrated solid bleach compositions in accordance with the invention can be prepared from solid cyanamide and a solid peroxide-based bleach (e.g., sodium perborate or percarbonate) without the need for a buffering agent to adjust the pH to below 5, as required for stable concentrated liquid bleach compositions. To ensure the stability of the solid bleach composition all that is required is that the composition be maintained free from contaminating amounts of moisture. This can be conveniently accomplished by use of desiccants and/or by encapsulating the cyanamide activator and/or the peroxide-based bleach as hereinafter discussed. To convert the stable concentrated solid bleach compositions of the present invention to their reactive state, all that is required is that they be added to the aqueous bleaching/washing medium maintained at a pH of above 7.5. Since solid peroxide-based bleaches such as sodium perborate and percarbonate are alkaline substances, the necessary pH above 7.5 will normally be obtained without further alkaline buffering agent addition. However, additional alkaline buffering agents can be (and usually are) employed to obtain the higher preferred pH levels.

From the foregoing it can be seen that the term "stable" as employed in connection with the liquid and solid concentrated bleach compositions in accordance with the invention, means the compositions are in an essentially inactive or non-reactive state (thereby facilitating their storage and handling), but can be readily converted to an active state at their time of use. In the case of concentrated liquid bleach compositions this is accomplished by pH adjustment from the below 5 level in storage, to an above 7.5 level in the aqueous bleaching/washing medium, while in the case of concentrated solid bleach compositions all that is required is that the solid cyanamide-activated peroxide-based bleach be added to an aqueous bleaching/washing medium.

An alternative method of practicing the present invention is to package the peroxide-based bleach and cyanamide (in solid or liquid form) in separate containers, and add them to the aqueous bleaching/washing medium together with appropriate alkaline buffering agents just prior to use, thereby forming the activated bleach composition in situ. In this manner premature reaction of the cyanamide and peroxide-based bleach can be avoided. Even if packaged separately, it is generally desirable that the pH of aqueous solutions of hydrogen peroxide and cyanamide be kept at the low pH values previously mentioned, in order to avoid decomposition of the peroxide or cyanamide as previously discussed. The stability of cyanamide can be enhanced, if desired, by the addition of trace amounts of phosphoric, acetic, sulfuric, or boric acid, or the salts thereof.

As mentioned above, a useful technique for increasing the stability of solid cyanamide activated peroxide-based bleach compositions is by use of the well known technique of encapsulation. In general, any encapsulating technique which provides a covering for the cyanamide activator and/or peroxide-based bleach particles which prevents their coming into direct contact until they are added to the aqueous bleaching medium can be suitably employed in the practice of the present invention. Thus, the function of the covering material (encapsulating agent) is to prevent premature reaction or decomposition of the cyanamide activator and peroxide-based bleach while in storage, yet effectively release the activator and/or bleach upon addition to the aqueous bleaching medium.

Suitable encapsulating agents include both water soluble and water dispersible substances, such as stearic acid, polyethylene glycols, condensation products of ethylene oxide and propylene oxide (e.g., alcohol ethoxylates), polyvinyl alcohol, carboxymethylcellulose, cetyl alcohol, fatty acid alkanol amides and the like. Encapsulation may be conveniently accomplished by dissolving the encapsulating agent in a volatile organic solvent and spraying the finely divided particles of cyanamide activator and/or peroxide activated bleach with the solution, after which the sprayed particles are dried. Such a procedure is described, for example, in U.S. Pat. No. 3,163,606. Other suitable encapsulation techniques are described in U.K. Pat. No. 1,395,006.

In addition to maintaining the pH at low levels during storage, e.g., at a pH of about 4, a further means f enhancing the stability of liquid hydrogen peroxide/-cyanamide bleach compositions is based on the discovery that the stability of such compositions is beneficially affected by the use of less than stoichiometric proportions of cyanamide to peroxide bleach in the composition. Specifically, it has been found that substantially improved stability is obtained if the molar ratio of cyanamide to hydrogen peroxide in the bleach composition is from 1:2 to about 1:10, preferably from about 1:2 to 1:4. The effect of using such low cyanamide to hydrogen peroxide ratios on the stability of aqueous formulations of cyanamide/hydrogen peroxide is shown in Example 5.

It is to be understood that while the aforementioned molar ratios are beneficial from a standpoint of storage stability, especially at higher temperatures, a broader range of ratios can be employed in accordance with the invention when high temperature stability is not a factor, or when other means of stabilizing the composition are employed, or if the hydrogen peroxide and cyanamide are added to the bleaching/washing medium as separate ingredients and the compositions in accordance with the invention formed in situ in the bleaching/washing medium. Hence, to practice the present invention all that is required is that an activating amount of cyanamide be present in the aqueous bleaching/washing medium containing a perioxide-based bleach and buffered to the appropriate pH. The form of cyanamide for introduction into the bleach system is not critical, and such introduction can be accomplished by employing cyanamide as such in solid or aqueous solution form, or by the use of a cyanamide-releasing compound. Generally the molar ratio of cyanamide activator to the peroxide-based bleach will be in the order of 1:20 to 20:1, with preferred ratios being from about 1:1 to about 1:10. If high temperature storage stability is desired, the proportions disclosed in the preceding paragraph can be suitably employed.

The amount of peroxide-based bleach employed in accordance with the invention will vary widely depending on the material to be bleached, the extent of bleaching desired, and the bleaching conditions. In general, the amounts of peroxide-based bleach, calculated as hydrogen peroxide, in the stable concentrated liquid bleach compositions will range from 2.5 to about 35 percent by weight (%w) of the total composition, preferably from about 3 to about 15%w. The amount of peroxide-based bleach employed in the stable concentrated solid bleach compositions, calculated as hydrogen peroxide, will range from about 1 to abut 35%w, preferably from about 2 to about 15%w. Peroxide concentrations higher than 35%w, calculated as hydrogen peroxide, could be used, but generally would not, because of the reactivity of highly concentrated peroxide solutions with organic material which can form detonable mixtures. In cases where the peroxide-based bleach and cyanamide are incorporated into a conventional detergent composition, lower concentrations of peroxide-based bleach (e.g., from 0.1 to 2%w, calculated as hydrogen peroxide) can be employed. However, in this case obviously lower levels of bleaching will be obtained than if the aforementioned concentrated cyanamide-activated peroxide-based bleach compositions are employed.

To effect bleaching, the activated peroxide-based bleach compositions of the invention are generally added to an aqueous medium in an amount that will result in 2 to 600 millimoles/liter (mmoles/1) of the peroxide-based bleach, calculated as hydrogen peroxide, being present in the aqueous medium. The precise peroxide-based bleach concentration selected will vary depending on the nature of the substance being bleached and the degree of bleaching desired.

For home and commercial laundry applications, the concentration of peroxide-based bleach in the present compositions should suitably be such that the concentration of peroxide-based bleach, calculated as hydrogen peroxide, in the wash water will be about 2 to 12 mmoles/1. As would be apparent to those skilled in the art, the foregoing concentrations could be varied if greater or less bleaching is desired.

The present compositions can be employed over a relatively wide range of temperatures, e.g., from about 45° F up to the boiling point of water (212° F). However, it can most advantageously be employed at temperatures of 60° to 160° F, which encompasses typical temperatures of home laundering in the United States. As previously stated, a substantial improvement in bleaching effectiveness is obtained by use of the present compositions as compared to the use of peroxide-based bleaches alone, or peroxide-based bleaches activated with many of the prior art activators.

The cyanamide-activated bleaching compositions of ıe present invention can be employed to bleach any of wide variety of bleachable substances including tex-les, wood and wood products, surfactants, leather, ıir and any other substances commonly bleached with ɜroxide-based bleaches. The present cyanamide-ɜtivated peroxide-based bleach compositions are es-ɜcially suitable for use in home and commercial laun-ɜring applications, wherein unactivated peroxide-ısed bleaches are largely ineffectual because of the ɜlatively short wash cycles and lower water tempera-ıres involved, particularly in the United States. The ɔmpositions of the invention are effective in bleaching ains from a variety of fabrics, including those manu-ctured from natural as well as synthetic fibers. They 'e particularly effective for bleaching cotton goods ıd goods produced from synthetic fibers, and are lvantageous over chlorine-based bleaches in that they ɔ not cause yellowing of fabrics even after repeated ashings. In addition, the compositions of the present vention cause considerably less loss in strength of ɔers than do chlorine-based bleaches, and are also fer to use on colored materials. The present composi-ɔns can be safely employed in their concentrated or lute forms, may be used for presoaking as well as ıring washing.

In the case of home or commercial laundering, the ɔmpositions of the present invention will normally be nployed in conjunction with a soap or detergent, hich may be provided as a part of the bleach/washing ɔmposition, or may be added separately to the wash ıuor. In general, any commonly used soap may be nployed for this purpose, for example, alkali metal lts of fatty acids, such as stearic and/or palmitic acids, · of rosin acids. Synthetic detergents which can be ıed with or without such soaps include the anionic, ıtionic, zwitterionic, ampholytic, non-ionic and semi-ɔlar organic surface-active agents. Typical anionic ɜtergents which can be employed in the practice of e present invention include various sulfates and sulfo-ıtes, such as alkyl aryl sulfonates, alkyl sulfonates, lfates of fatty acid-monoglycerides, olefin sulfonates, lfonated fatty acids and esters, alkyl glyceryl ether lfonates, fatty isethionates, fatty acid oxyethylamide lfates, oleylmethyltaurides, and the like having ali-ıatic hydrogen chains of about 10 to about 20 carbon oms, and alkyl sulfate, alkyl polyether sulfate and kylphenol polyether sulfate salts such as sodium lau-l sulfate, sodium alkyl phenol polyether sulfates and ixed secondary alkyl sulfate alkali metal salts of 8 to ; carbon atoms per molecule. Examples of non-ionic rface active agents which can be used in the practice the invention are the saponines, fatty alkanolamides, ıine oxides and ethylene oxide and propylene oxide ndensation products with fatty acids, alcohols, poly-opylene glycols, alkyl phenols, esters, and the like, pecially those with alkyl chains of 8 to 20 carbon ɔms and 3 to 20 glycol units per molecule. Examples typically suitable cationic surface active agents in-ıde those based on diamines, e.g., N-aminoethyl stea-l amine and N-aminoethyl myristyl amine; amide-ked amines, e.g., N-aminoethyl-stearyl amide and aminoethyl myristyl amide; quaternary ammonium mpounds containing at least one long chain alkyl ɔup attached to the nitrogen atom, e.g., ethyl-nethy-stearyl ammonium chloride and dimethylpro-l-myristyl ammonium chloride; and the like.

Any of the builders or other additives conventionally employed in bleach and/or detergent products can be used in the bleaching compositions of the invention. These include, for example, alkaline materials such as alkali metal hydroxides, phosphates (including orthophosphates, tripolyphosphates and pyrophosphates), carbonates, bicarbonates, citrates, polycarboxylates, borates and silicates, also alkanolamines and ammonia. Inert compounds such as alkali metal sulfates or chlorides can also be employed.

It has been found that the presence of sodium tripolyphosphate (STPP) and trisodium phosphate(TSP) in the aqueous bleaching/washing medium further enhances the bleaching action of the cyanamide-activated peroxide-based bleach. Hence, in a preferred embodiment of the present invention, STPP or TSP (or a detergent containing either of these compounds) is added to the aqueous bleaching/washing medium in addition to the peroxide-based bleach, cyanamide activator and alkaline buffering agent.

Group II A metal compounds such as magnesium and/or calcium salts can also be added to the aqueous bleaching medium to further enhance the bleaching action of the cyanamide-activated peroxide-based bleach system as discussed in copending U.S. application Ser. No. 656,456, filed Feb. 9, 1976.

Other additives which may optionally be incorporated in or used in conjunction with the instant compositions include fabric softeners, germicides, fungicides, enzymes, anti-redeposition agents, flocculents, optical brighteners, colorants, perfumes, thickeners, stabilizers, suds-builders or suds-depressants, anti-corrosion agents, fluorescent agents, and the like.

The activated bleaching compositions of the invention may generally also be used for their germicidal properties in various applications, for example, as a disinfectant for use in the home, e.g., in kitchens, bathrooms, etc., for institutional use, for water treatment and the treatment of swimming pools, etc.

The present invention and its benefits are further described in the following examples, which are intended only to be illustrative of the invention, and should not be construed as limiting.

EXAMPLE 1

The following experiments evidence the improved bleaching action obtainable by practice of the present invention. The general procedure employed in these tests was as follows:

Five hundred (500) ml of deionized water was added to a U.S. Testing, Inc. Terg-O-Tometer bath maintained at the temperature shown in Table I and the hardness level of the water adjusted to 150 ppm as $CaCO_3$ (Ca/Mg = 3/2 on a molar basis). The pH of the water in the bath was adjusted to the values shown in Table I by the addition of $Na_2CO_3$ or NaOH. The peroxide-based bleach and/or cyanamide activator and detergent were then added to the wash water in the concentrations shown in Table I, and the water agitated to avoid localized concentrations of any one additive. Finally, eight swatches, measuring 4 × 4 inches, of EMPA 115 cloth (a standard cotton bleach test cloth soiled with sulfur black dye) were introduced into the wash water and the agitator run for 10, 20, 30 or 60 minutes at 100 rpm. At the conclusion of each wash period, two swatches were removed and rinsed by squeezing under a tap. The test cloths were then dried and the reflectance values measured on a Gardner Reflectometer, Model UX-2, utilizing a G filter. The change that occurred as a result of the bleach/wash cycle was reported as the change in percent reflectance value (ΔR), which equals the difference between the reflectance of the swatch after bleaching and the reflectance of the same swatch before bleaching. Thus the larger the ΔR value, the more effective the bleaching action.

The compositions tested and the results obtained are presented in the following table.

TABLE I

| Experiment No. | Bleach,[a] mmoles/l | Cyanamide, mmoles/l | Detergent,[b] g/l | pH Initial | pH Final | Temp., °F | ΔR Wash Cycle 10 mins | 20 mins | 30 mins | 60 mins |
|---|---|---|---|---|---|---|---|---|---|---|
| 1 | 8 | 0 | 1.5 | 9.8 | 9.5 | 185 | 4.3 | 7.5 | 9.7 | — |
| 2 | 8 | 8 | 1.5 | 9.2 | 8.9 | 185 | 26.4 | 31.9 | 33.6 | — |
| 3 | 8 | 0 | 1.5 | 9.7 | 9.6 | 120 | 0.8 | 1.5 | 1.9 | — |
| 4 | 8 | 8 | 1.5 | 9.1 | 8.8 | 120 | 17.3 | 25.1 | 29.0 | — |
| 5 | 8 | 0.8 | 1.5 | 9.6 | 9.5 | 120 | 7.7 | 11.7 | 12.5 | — |
| 6 | 8 | 0.4 | 1.5 | 9.7 | 9.5 | 120 | 4.9 | 7.3 | 8.5 | — |
| 7 | 8 | 0 | 1.5 | 9.6 | 9.2 | 75 | 0.1 | 0.9 | 0.7 | — |
| 8 | 8 | 8 | 1.5 | 9.1 | 8.8 | 75 | 6.1 | 11.5 | 16.5 | — |
| 9 | 8 | 0 | 1.5 | 9.3 | 9.0 | 45 | — | — | 0.8 | 0.5 |
| 10 | 8 | 8 | 1.5 | 8.9 | 8.8 | 45 | — | — | 3.7 | 7.2 |
| 11 | 8 | 8 | 1.5 | 11.5 | 11.3 | 185 | 24.9 | 27.9 | 30.1 | — |
| 12 | 8 | 8 | 1.5 | 11.7 | 11.6 | 185 | 19.5 | 24.5 | 27.2 | — |

[a]Hydrogen peroxide (introduced as a stabilized, commercial grade 50% aqueous solution).
[b]Tide containing 6.1% phosphorus (Tide, 6.1% P). Tide is a powdered detergent manufactured by Procter & Gamble Company.

The foregoing tests indicate that the compositions of the invention containing cyanamide and hydrogen peroxide in various proportions provide excellent bleaching action over a wide range of temperatures and concentrations.

EXAMPLE 2

In this example a series of experiments was conducted at 120° F to further demonstrate the effect of concentration and pH on the bleaching effectiveness of the present compositions. The test procedure employed was essentially the same as in Example 1 unless otherwise indicated. The compositions tested and the results obtained are summarized in Table II.

TABLE II

| Experiment No. | Bleach,[a] mmoles/l | Cyanamide, mmoles/l | Detergent,[b] g/l | pH Initial | pH Final | Temp. °F | ΔR Wash Cycle 10 mins | 20 mins | 30 mins |
|---|---|---|---|---|---|---|---|---|---|
| 13 | 16 | 0 | 1.5 | 9.8 | 9.5 | 120 | 1.1 | 1.6 | 2.3 |
| 14 | 0 | 16 | 1.5 | 9.8 | 9.7 | 120 | 0.5 | 0.8 | 0.9 |
| 15 | 8 | 8 | 1.5 | 9.3 | 8.8 | 120 | 18.1 | 26.0 | 30.3 |
| 16 | 8 | 80 | 1.5 | 9.8 | 9.8 | 120 | 13.3 | 14.7 | 15.8 |
| 17 | 8 | 160 | 1.5 | 9.6 | 9.7 | 120 | 11.4 | 12.5 | 13.5 |
| 18 | 8 | 8 | — | 2.9 | 2.8 | 120 | 0 | 0 | 0.2 |
| 19 | 8 | 8 | — | 7.0 | 7.2 | 120 | 0.3 | 1.4 | 3.8 |
| 20 | 8 | 8 | — | 11.4 | 11.5 | 120 | 21.1 | 27.7 | 30.4 |
| 21 | 8 | 8 | — | 12.6 | 12.6 | 120 | 4.0 | 8.6 | 11.7 |

[a]Hydrogen peroxide (introduced as a stabilized, commercial grade 50% aqueous solution).
[b]Tide, 6.1% P.

The foregoing data indicate that the combination of cyanamide with a peroxide-based bleach gives substantially greater bleaching action than the use of equivalent amounts of these components individually. The results also reflect that the bleaching effectiveness is pH dependent, with little or no activation occurring under the test conditions at pH values of 7 and below.

EXAMPLE 3

In this example a series of experiments was conducted utilizing the test procedures outlined in Example 1, except as otherwise noted, to compare the bleaching effectiveness of several commercially available peroxide-based bleaches when used alone, to the same bleaches containing cyanamide as an activator. The commercial peroxide-based bleaches employed in these experiments are listed in Table III, while the results of the experiments are tabulated in Table IV.

TABLE III

| Product | Type | % $H_2O_2$[c] |
|---|---|---|
| Bleach A | Liquid[a] | 5.9 |
| Bleach B | Liquid[a] | 3.2 |
| Bleach C | Solid[b] | 4.9 |
| Bleach D | Solid[b] | 8.0 |
| Bleach E | Solid[b] | 7.5 |
| Bleach F | Solid[b] | 4.9 |

[a]Aqueous hydrogen peroxide.
[b]Contains sodium perborate which dissolves in wash water to form hydrogen peroxide.
[c]Determined by iodometric titration.

TABLE IV

| Experiment No. | Product[a] | Product Only % $H_2O_2$ Utilized[b] | Product Only ΔR | Product plus Cyanamide[c] % $H_2O_2$ Utilized[b] | Product plus Cyanamide[c] ΔR |
|---|---|---|---|---|---|
| 22 | Bleach A | 0 | 3.1 | 95 | 17 |
| 23 | Bleach B | 0 | 3.2 | 90 | 17 |
| 24 | Bleach C | 0 | 3.5 | 89 | 14 |
| 25 | Bleach D | 0 | 4.1 | 91 | 8 |
| 26 | Bleach E | 0 | 2.5 | 94 | 11 |
| 27 | Bleach F | 0 | 2.4 | 83 | 11 |

[a]Added to wash water at pH 9.6–10 to provide initial $H_2O_2$ concentration of 8.8 mmoles/l. Washing conditions other than those shown in Example 1: Detergent concentration 1.5 g/l Tide, 6.1% P, temperature of all runs 120 F, wash cycle 10 mins.
[b]Determined by iodometric titration on 50–100 ml of wash liquor immediately (within one minute) after wash.
[c]$H_2NCN$ concentration 8.8 mmoles/l.

The foregoing test results indicate that while the commercial peroxide-based bleaches are virtually ineffective in bleaching the test cloth under the conditions shown, the addition of cyanamide as an activator substantially improves their performance and results in utilization of virtually all of the hydrogen peroxide.

EXAMPLE 4

A series of experiments was conducted to compare the bleaching effectiveness of the cyanamide activated peroxide-based bleach compositions of the present invention to peroxide-based bleaches activated with various organic nitrile activators disclosed in the prior art. The test procedure employed was essentially the same as that utilized in Example 3. The compositions tested and results obtained are presented in Table V.

TABLE V

| Experiment No. | Activator Compound | Activator mmoles/l | $H_2O_2$ mmoles/l | $H_2O_2$ Added as | pH wash water | ΔR |
|---|---|---|---|---|---|---|
| 28 | None | — | 8.8 | 50% $H_2O_2$ | 9.6 | 2.4 |
| 29 | Dicyanodiamide | 9.5 | 8.8 | 50% $H_2O_2$ | 9.6 | 1.7 |
| 30 | Dicyanodiamide | 17.6 | 17.6 | 50% $H_2O_2$ | 10.1 | 3.3 |
| 31 | Acetonitrile | 9.3 | 9.1 | SPB-4[a] | 10.1 | 1.4 |
| 32 | Malononitrile | 9.1 | 9.1 | SPB-4 | 9.2 | 1.2 |
| 33 | Malononitrile | 9.1 | 9.1 | SPB-4 | 9.7 | 1.8 |
| 34 | Benzonitrile | 9.1 | 9.1 | SPB-4 | 10.1 | 3.3 |
| 35 | p-Nitrobenzonitrile | 9.5 | 8.8 | 50% $H_2O_2$ | 9.7 | 7.2 |
| 36 | Phthalonitrile | 9.1 | 9.1 | SPB-4 | 10.0 | 14.8[b] |
| 37 | Phthalonitrile | 9.1 | 9.1 | 50% $H_2O_2$ | 9.7 | 10.0[b] |
| 38 | Cyanamide | 9.1 | 9.1 | SPB-4 | 9.6 | 20.1[b] |
| 39 | Cyanamide | 9.1 | 9.1 | 50% $H_2O_2$ | 9.7 | 19.4[c] |

[a]SPB-4 = sodium perborate tetrahydrate
[b]Average of triplicate runs
[c]Average of quadruplicate runs The foregoing results indicate that hydrogen peroxide alone does not provide appreciable bleaching at the test temperature (120° F). However, in combination with cyanamide, hydrogen peroxide added in the form of a stabilized, commercial grade 50% aqueous solution, or as sodium perborate tetrahydrate, exhibits significant bleaching action, far superior to low molecular weight organic nitriles such as acetonitrile and malononitrile, and significantly superior to higher molecular weight organic nitriles such as p-nitrobenzonitrile and phthalonitrile.

EXAMPLE 5

A series of experiments was conducted to demonstrate the effect of concentration of high temperature stability of liquid cyanamide/peroxide-based bleach formulations in accordance with the invention. One of the compositions employed in these tests contained approximately stoichiometric amounts of cyanamide and hydrogen peroxide, while the remaining compositions contained reduced ratios of cyanamide to hydrogen peroxide as shown in Table VI.

The formulations utilized in this series of experiments were prepared from a stabilized, commercial grade 50% aqueous hydrogen peroxide and solid cyanamide, which were added to deionized water in the concentrations shown in the table, and the pH adjusted to about 4 using dilute sulfuric acid.

The percentage of hydrogen peroxide, pH and the bleaching effectiveness of each of the formulations was determined upon preparation, and after 5 and 7 days storage in a loosely capped bottle in an oven at 50° C. The hydrogen peroxide concentration was determined by iodometric titration. The results of the tests were as follows:

TABLE VI

| Experiment No. | Concentration (% w) $H_2O_2$ | Concentration (% w) $H_2NCN$ | Stability at 50° C at Day 0 % $H_2O_2$ | Day 0 pH | Day 0 ΔR[a] | Day 5 % $H_2O_2$ | Day 5 pH | Day 5 ΔR[a] | Day 7 % $H_2O_2$ | Day 7 pH | Day 7 ΔR[a] |
|---|---|---|---|---|---|---|---|---|---|---|---|
| 40 | 6 | 7.7 | 6.1 | 4.0 | 14 | 0 | 8.1 | 1.5 | — | — | — |
| 41 | 6 | 3.8 | 6.0 | 4.0 | 17 | 5.5 | 3.5 | 14 | 2.7 | 7.9 | 1.8 |
| 42 | 12 | 7.7 | 12.0 | 4.0 | — | 9.3 | 4.0 | 25 | 2.4 | 8.0 | 1.2 |

[a]For each test 2.5g of formulation was added to the wash water. The same test procedure employed as in Example 3, except that 2.0 g/l of Tide, 6.1% P was added to the wash water to obtain the proper pH.

EXAMPLE 6

A series of experiments was conducted to determine the effect, if any, of commonly employed detergent builders on the bleaching action of the present cyanamide-activated peroxide-based bleach system. The test procedure employed was similar to that described in Example 1, except that deionized water with no added hardness or detergent was employed in the Terg-O-Tometer bath. In addition to the test runs with various detergent builders, a number of the experiments presented in Example 4 were repeated in the absence of added hardness and detergent at various pH levels. The compositions tested and the results obtained are shown in the following table. The temperature of the Terg-O-Tometer bath in all of these tests was 120° F.

TABLE VII

| Experiment No. | Activator Compound | Activator mmoles/l | $H_2O_2$ mmoles/l | Builder Type | Builder mmoles/l | pH Initial | pH Final | ΔR Wash Cycle 10 mins | ΔR Wash Cycle 20 mins | ΔR Wash Cycle 30 mins |
|---|---|---|---|---|---|---|---|---|---|---|
| 43 | None | — | 8 | None | — | 9.7 | 9.2 | 1.0 | 1.3 | 1.6 |
| 44 | Cyanamide | 8 | 8 | None | — | 9.4 | 9.3 | 6.7 | 9.6 | 11.0 |
| 45 | Cyanamide | 8 | 8 | STPP | 1 | 9.5 | 9.4 | 16.8 | 20.6 | 22.9 |
| 46 | Cyanamide | 8 | 8 | TSP | 3 | 9.5 | 9.4 | 11.5 | 16.0 | 18.8 |
| 47 | Cyanamide | 8 | 8 | $Na_2SiO_3$ | 4 | 9.7 | 9.8 | 5.7 | 7.9 | 9.0 |
| 48 | Cyanamide | 8 | 8 | $Na_2CO_3$ | 4 | 9.5 | 9.5 | 6.8 | 8.5 | 9.5 |
| 49 | Cyanamide | 8 | 8 | $Na_2B_4O_7$ | 4 | 9.2 | 9.2 | 6.0 | 9.2 | 10.8 |
| 50 | Benzonitrile | 8 | 8 | None | — | 9.6 | 9.4 | 0.9 | 1.7 | 3.1 |

TABLE VII-continued

| Experiment No. | Activator Compound | Activator mmoles/l | $H_2O_2$ mmoles/l | Builder Type | Builder mmoles/l | pH Initial | pH Final | ΔR Wash Cycle 10 mins | ΔR Wash Cycle 20 mins | ΔR Wash Cycle 30 mins |
|---|---|---|---|---|---|---|---|---|---|---|
| 51 | p-Nitro-benzo-nitrile | 8 | 8 | None | — | 9.7 | 9.4 | 2.5 | 3.1 | 4.2 |
| 52 | Phthalo-nitrile | 8 | 8 | None | — | 7.5 | 7.1 | 1.3 | 2.6 | 2.9 |
| 53 | Phthalo-nitrile | 8 | 8 | None | — | 8.5[a)] | 7.9 | 1.9 | 3.5 | 4.1 |
| 54 | Phthalo-nitrile | 8 | 8 | None | — | 9.5 | 7.5 | 4.2 | 5.4 | 6.1 |
| 55 | Phthalo-nitrile | 8 | 8 | None | — | 9.5[a)] | 8.9 | 7.1 | 8.4 | 9.5 |
| 56 | Phthalo-nitrile | 8 | 8 | None | — | 10.2 | 10.1 | 5.7 | 5.3 | 6.5 |
| 57 | Cyanamide | 8 | 8 | None | — | 7.5 | 7.3 | 5.9 | 11.7 | 18.4 |
| 58 | Cyanamide | 8 | 8 | None | — | 8.0 | 7.5 | 10.0 | 20.2 | 26.9 |
| 59 | Cyanamide | 8 | 8 | None | — | 8.5 | 8.0 | 9.9 | 17.0 | 22.9 |
| 60 | Cyanamide | 8 | 8 | None | — | 9.2 | 9.0 | 8.2 | 11.3 | 13.4 |
| 61 | Cyanamide | 8 | 8 | None | — | 10.3 | 10.2 | 6.4 | 7.7 | 8.2 |

[a)]Phthalonitrile in this pH range appears to hydrolyze rapidly to phthalic acid. Sodium hydroxide was added continually during these experiments in an attempt to maintain the initial pH.

The foregoing test results indicate that while silicates, carbonates and borates have no appreciable affect on the bleaching activity of the cyanamide-activated bleach system, sodium tripolyphosphate and trisodium phosphate synergistically interact with the cyanamide-activated peroxide-based bleach to give even further bleach enhancement. The tests comparing cyanamide to prior art nitriles again indicate that cyanamide is far superior to benzonitrile and p-nitrobenzonitrile as a peroxide-activator. Likewise cyanamide is superior to phthalonitrile at each of the pH levels tested, and exhibits particularly pronounced advantages over phthalonitrile at longer wash cycles, and is not subject to the pH adjustment problems of phthalonitrile.

EXAMPLE 7

In this example Philippine mahogany was bleached employing a cyanamide-activated peroxide-bleaching composition in accordance with the invention. Hydrogen peroxide and cyanamide were made up separately as 20% aqueous solutions. The peroxide solution was adjusted to a pH of 9–10 with sodium hydroxide.

Separate pieces of Philippine mahogany were then treated at room temperature with a blend of the aforementioned cyanamide and hydrogen peroxide solutions in stoichiometric proportions, and with the cyanamide solution first, followed by treatment with the alkaline peroxide solution, and vice versa. A piece of mahogany was also treated with unactivated alkaline hydrogen peroxide for comparison purposes.

The results of these tests indicate that the pieces of mahogany treated with both cyanamide and hydrogen peroxide were bleached more rapidly than those treated with alkaline hydrogen peroxide alone. The most effective procedure was to first contact the dry wood with the cyanamide solution, followed by applications of the alkaline hydrogen peroxide solution. While the unactivated alkaline hydrogen peroxide solution ultimately bleached the mahogany substrate, it required more applications and longer contact time to achieve the same degree of bleaching.

EXAMPLE 8

To demonstrate the effectiveness of cyanamide in activating a peroxide-based bleach of the percarbonatetype, a test similar to that used in Example 4 was conducted in a Terg-O-Tometer bath maintained at 120° F. containing 8.8 mmoles/l of hydrogen peroxide derived from sodium percarbonate ($3Na_2CO_3 \cdot 2H_2O_2$), 9.1 mmoles/l of cyanamide activator and 1.0 g/l of detergent. The pH of the wash water was 9.8. The ΔR value obtained for the cyanamide/percarbonate combination was 18.

EXAMPLE 9

In addition to the cotton bleach test clothes utilized in the tests reported in the previous examples, cyanamide-activated bleaching compositions in accordance with the invention were tested at full scale home laundry conditions and were found to be effective in bleaching a variety of cotton materials as well as other fabrics, with and without finishes, including nylon, silk, Orlon, Dacron/cotton blends and linens. Among the stains "bleached-out" during regular and extended wash cycles were bacon grease, grape juice, tea, coffee, dried blood and cooking oils.

EXAMPLE 10

The following tests evidence the substantial benefits which can be realized by use of compositions of the present invention, even under higher-temperature European-type laundry conditions, especially if short wash cycles are employed. In these tests the wash cycles were conducted at a temperature of 188° F with increased concentrations of detergent (Tide, 8.7%P). The compositions tested and results obtained were as follows:

TABLE VIII

| Experiment No. | $H_2O_2$ mmoles/l | Cyanamide mmoles/l | Detergent g/l | ΔR Wash Cycle 10 mins | ΔR Wash Cycle 20 mins | ΔR Wash Cycle 30 mins | ΔR Wash Cycle 60 mins |
|---|---|---|---|---|---|---|---|
| 62 | 8 | 0 | 5 | 8 | 11 | 15 | 18 |
| 63 | 8 | 8 | 5 | 16 | 17 | 19 | 20 |

EXAMPLE 11

In this example an encapsulated solid bleaching composition in accordance with the invention was prepared and subjected to a high temperature storage stability test. In this test an encapsulated bleaching composition containing 3.9%w cyanamide (solid), 18.6%w sodium perborate monohydrate, 10.6%w magnesium sulfate and 66.9%w sodium sulfate, was placed in an open beaker in an oven at 50° C and the bleaching effectiveness of the composition determined at the outset of the test and at random intervals by removing a portion of the sample from the oven and bleaching a test fabric with it to determine its ΔR potential. The bleach composition was encapsulated by blending 100 parts by weight of the aforementioned ingredients with 35 parts by weight of Neodol 45–50 (a $C_{14-15}$ linear, primary alcohol ethoxylate) which had been liquified by heating to facilitate encapsulation. The test results on the encapsulated composition showed that after four weeks of continuous storage at 50° C (122° F) the bleaching effectiveness of the composition remained at 90% of its original value.

It is to be understood that the foregoing detailed description of the invention and examples are merely given by way of illustration, and that many variations may be made therein without departing from the spirit and scope of the invention.

What is claimed is:

1. A process for activating a peroxide-based bleach which comprises conjointly incorporating into an aqueous medium effective amounts of (a) a peroxide-based bleach, (b) a peroxide-activating amount of cyanamide and (c) a buffering agent to maintain the pH of the aqueous medium above 7.5.

2. The process of claim 1 wherein the peroxide-based bleach is hydrogen peroxide, sodium perborate or sodium percarbonate.

3. The process of claim 1 wherein the temperature of the aqueous bleaching medium is from about 60° to 160° F.

4. The process of claim 1 wherein sodium tripolyphosphate or trisodium phosphate is additionally incorporated into the aqueous medium.

5. The process of claim 2 wherein the amount of buffering agent is sufficient to maintain the pH of the aqueous medium within the range of about 8.0 to about 11.5.

6. The process of claim 5 wherein a detergent is additionally incorporated into the aqueous medium.

7. The process of claim 2 wherein the peroxide-based bleach is sodium perborate.

8. A stable concentrated liquid bleaching composition consisting essentially of an aqueous solution of from 2.5 to about 35% by weight, calculated as hydrogen peroxide, of a peroxide-based bleach, a peroxide-activating amount of cyanamide and a buffering agent to maintain the pH of the aqueous solution from about 2 to 5.

9. The composition of claim 8 wherein the amount of peroxide-based bleach in the bleaching composition is from about 3 to about 15% by weight, calculated as hydrogen peroxide, of the total composition.

10. The composition of claim 9 wherein the molar ratio of cyanamide to peroxide-based bleach is 1:20 to 20:1.

11. The composition of claim 10 wherein the peroxide-based bleach is hydrogen peroxide.

12. The composition of claim 11 wherein the molar ratio of activator to hydrogen peroxide is 1:1 to 1:10.

13. The composition of claim 12 wherein the aqueous solution is buffered to pH of about 4.

14. A stable concentrated solid bleaching composition consisting essentially of a solid mixture of peroxide-based bleach and a peroxide-activating amount of cyanamide as an activator therefore.

15. The composition of claim 14 wherein the amount of peroxide-based bleach in the bleaching composition is from 1 to about 35% by weight, calculated as hydrogen peroxide, of the total composition.

16. The composition of claim 15 wherein the molar ratio of cyanamide to peroxide-based bleach is 1:20 to 20:1.

17. The composition of claim 16 wherein the peroxide-based bleach is a sodium perborate.

18. The composition of claim 16 wherein the peroxide-based bleach is sodium percarbonate.

19. The composition of claim 16 which additionally contains a desiccant.

20. The composition of claim 16 which additionally contains a detergent.

21. The composition of claim 16 wherein the peroxide-based bleach or cyanamide activator therefore is encapsulated.

22. A bleaching/washing composition consisting essentially of an aqueous medium containing from about 2 to about 600 millimoles/liter of hydrogen peroxide, a peroxide-activating amount of cyanamide, a buffering agent to maintain the pH of the aqueous medium within the range of 7.5 to about 13, and a bleachable substance.

23. The composition of claim 22 additionally containing a detergent.

24. The composition of claim 23 wherein the aqueus medium contains from about 2 to about 12 millimoles/liter of hydrogen peroxide and sufficient buffering agent to maintain the pH within the range of about 8.0 to about 11.5.

25. The composition of claim 24 wherein the bleachable substance is a fabric.

26. In a built process for manufacturing a built laundry detergent composition comprising a synthetic, detergent and an alkaline detergent builder, the improvement which comprises incorporating into said composition from 0.1 to 2% by weight, calculated as hydrogen peroxide, of a peroxide-based bleach and a peroxide-activating amount of cyanamide.

27. A laundry detergent composition consisting essentially of (1) a major amount of synthetic detergent and an alkaline detergent builder, (2) a minor amount, from 0.1 to 2% by weight, calculated as hydrogen peroxide, of a peroxide-based bleach and (3) a peroxide activating amount of cyanamide.

* * * * *